US005133143A

United States Patent [19]

Knight

[11] Patent Number: 5,133,143

[45] Date of Patent: Jul. 28, 1992

[54] BREECH PLUG FOR A MUZZLE-LOADING FIREARM

[75] Inventor: William A. Knight, Plano, Iowa

[73] Assignee: Modern Muzzle Loading, Inc., Centerville, Iowa

[21] Appl. No.: 823,377

[22] Filed: Jan. 21, 1992

[51] Int. Cl.[5] ..... F41C 9/08

[52] U.S. Cl. ..... 42/51

[58] Field of Search ..... 42/51, 83

[56] References Cited

U.S. PATENT DOCUMENTS

| | | | |
|---|---|---|---|
| 158,221 | 12/1874 | Smith | 42/51 |
| 3,757,447 | 9/1973 | Rowe | 42/51 |
| 4,137,663 | 2/1979 | Farber | 42/51 |
| 4,222,191 | 9/1980 | Lee et al. | 42/51 |
| 4,700,499 | 10/1987 | Knight | 42/51 |
| 4,888,901 | 12/1989 | French et al. | 42/51 |

*Primary Examiner*—Charles T. Jordan

*Attorney, Agent, or Firm*—Zarley, McKee, Thomte, Voorhees & Sease

[57] ABSTRACT

A breech plug for a muzzle-loading firearm is disclosed wherein the breech plug includes a soft metal insert to provide a soft metal-to-steel seal between the breech plug insert and the barrel of the firearm to prevent blow-by. The insert also provides for a soft metal-to-steel engagement between the forward end of the nipple and the breech plug insert to prevent blow-by when the powder charge on the nipple is ignited.

10 Claims, 2 Drawing Sheets

BREECH PLUG FOR A MUZZLE-LOADING FIREARM

BACKGROUND OF THE INVENTION

In muzzle-loading firearms, a barrel extends forwardly from the forward end of a receiver. A breech is provided at the rearward end of the barrel and receives the propellant, as well as a projectile. A breech plug is threadably mounted in the receiver and is normally comprised of a steel material, as is the receiver and barrel. The breech plug is provided to provide a seal between the forward end of the breech plug and the barrel to prevent blow-by of gases when the firearm is discharged. However, the steel-to-steel relationship does not provide a good seal between the breech plug and the barrel, which results in considerable blow-by when the rifle or firearm is fired. The residue is very dirty, and the rifle must be cleaned often.

In some muzzle-loading firearms, a nipple is mounted in the rear end of the breech plug and has a rearward end adapted to have a percussion cap mounted thereon. When the percussion cap is fired, ignition sparks travel the length of the nipple to ignite the propellant in the breech. Conventional nipples also provide a poor seal between the nipple and the breech plug. Further, the design of the ignition bore in the nipple provides a less than satisfactory fire path.

It is therefore a principal object of the invention to provide an improved ignition system, breech plug and nipple.

Yet another object of the invention is to provide a breech plug for a muzzle-loading firearm including a brass-like seal which seals the breech plug to the barrel so as to prevent blow-by.

Yet another object of the invention is to provide a breech plug, including an insert comprised of brass, aluminum, zinc, copper, etc. which also provides for a seal between the nipple and the breech plug.

Yet another object of the invention is to provide a nipple having a non-restrictive path of fire.

These and other objects will be apparent to those skilled in the art.

SUMMARY OF THE INVENTION

An improved breech plug for a muzzle-loading firearm is disclosed wherein the breech plug includes an insert comprised of brass, aluminum, copper, zinc, etc. which creates a soft metal to steel seal between the breech plug and the barrel to prevent blow-by when the firearm is discharged. The brass insert also provides an improved seal between the nipple and the breech plug. The nipple hole is sized to match the starting hole of the brass insert in the breech plug to provide an unrestricted fire path. Improved safety is achieved through containment of exploding gases by the breech plug instead of the nipple.

DESCRIPTION OF THE PREFERRED EMBODIMENT

Figure 1:
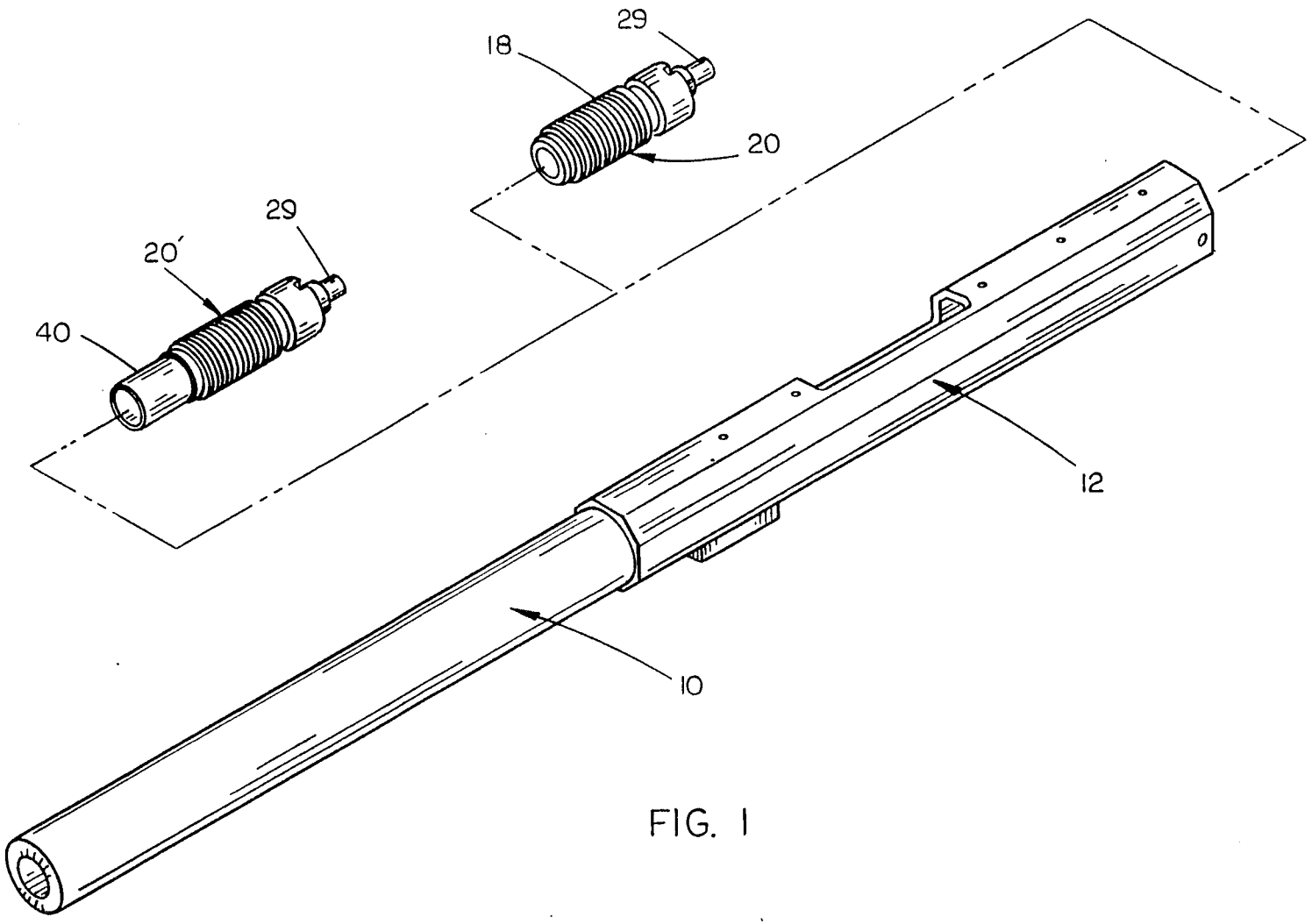
FIG. 1 is a perspective view of a portion of a muzzle-loading firearm and the two different types of breech plugs disclosed herein.
Figure 2:
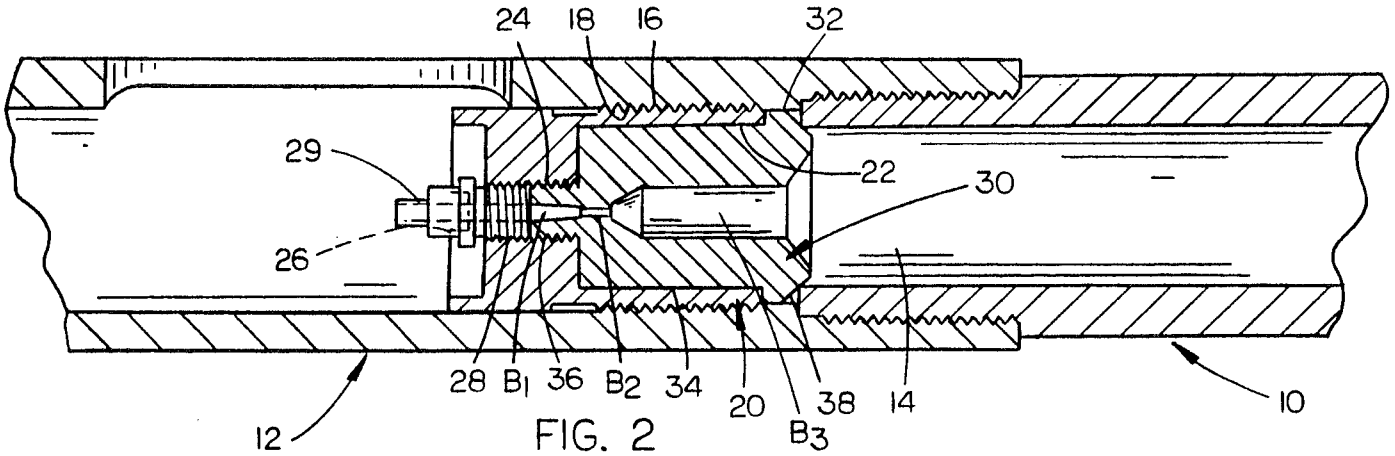
FIG. 2 is an elongated sectional view illustrating one form of the breech plug.
Figure 3:
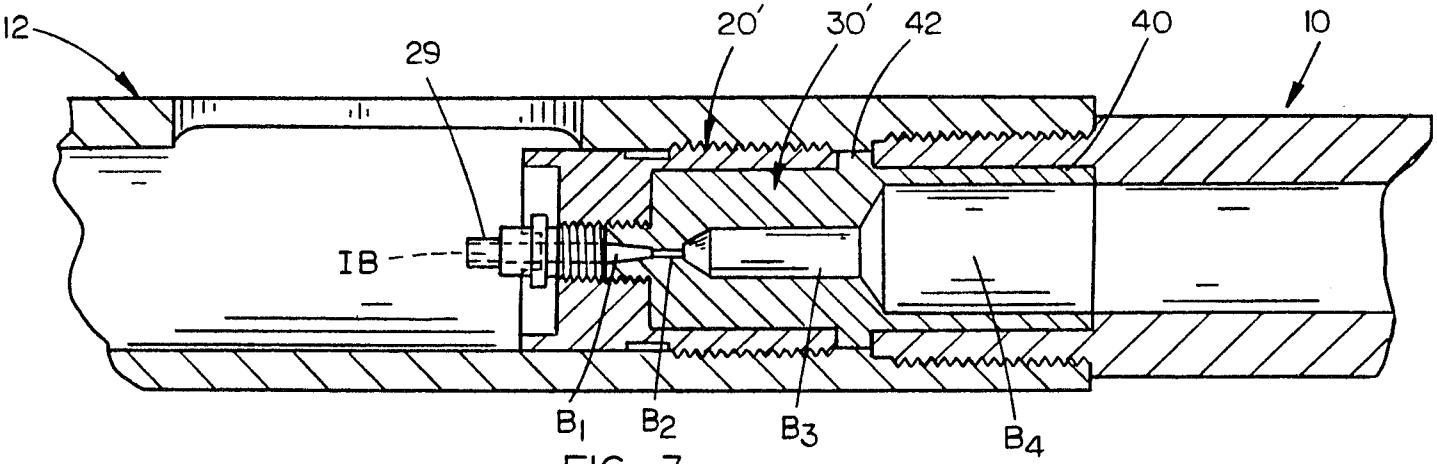
FIG. 3 is a longitudinal sectional view similar to FIG. 2 except that a modified form of the breech plug is disclosed.

In FIG. 1, the numeral 10 refers to a barrel of a muzzle-loading firearm. Although FIG. 1 illustrates the barrel to be rather short, the barrel could be of any desired length. Receiver 12 extends rearwardly from the rearward end of barrel 10 and may be threadably mounted thereon as illustrated in FIGS. 2 and 3 or may be an integral part of the barrel if so desired. At any rate, the numeral 14 refers generally to the breech, which is located at the rearward end of the barrel 10 and which is designed to receive the propellant and projectile.

Receiver 12 is provided with an internally threaded opening 16 near its forward end which is adapted to receive the external threads 18 of breech plug 20. Breech plug 20 is provided with an enlarged cylindrical bore 22 provided at the forward end thereof and a smaller threaded bore 24 provided at its rearward end. The rearward end of breech plug 20 is also provided with a notch 26 adapted to receive a tool for inserting or removing the breech plug. Breech plug 20 is also provided with an internally threaded opening 28 which is adapted to threadably receive the forward end of a nipple 29 and the rearward end 36 of an insert 30. Insert 30 is preferably comprised of a soft metal such as brass, aluminum, copper, zinc, etc. to achieve a soft metal to steel seal as will be described hereafter. The rearward end of nipple 29 is adapted to receive a percussion cap thereon in conventional fashion.

Insert 30 is threaded into opening 24 of breech plug 20 as illustrated in FIG. 2. Insert 30 includes an enlarged diameter portion 32 at its forward end, intermediate portion 34 and rear threaded portion 36. Enlarged diameter portion 32 is tapered at 38 to facilitate a sealing engagement between the forward end of insert 30 and the rear end of breech 14. Rear threaded portion 36 of insert 30 extends threadably rearwardly to the forward end of threaded portion 28 so that the forward end of nipple 29 will engage the rearward end of the insert 30 to provide a seal between the end of the nipple and the insert 30 to prevent blow-by. Insert 30 is provided with ignition bores $B_1$, $B_2$ and $B_3$ formed therein so that the burning gases from the detonated percussion cap on nipple 29 will travel therethrough to ignite the propellant in the breech 14. As seen, ignition bore $B_1$ is tapered with the ignition bore IB of the nipple being sized to match the rearward end of bore $B_1$ to provide an unrestricted fire path.

In the embodiment of FIG. 2, the insert 30 sealably engages the steel barrel 10 to prevent blow-by when the propellant in breech 14 is ignited when the firearm is discharged. The soft metal-to-steel engagement of the forward end of nipple 29 with the rearward end of insert 30 also aids in preventing blow-by as stated.

FIG. 3 illustrates a modified form of the invention which serves the same function as the invention described in FIG. 2. Instead of having a tapered forward end as did insert 30, insert 30' includes an elongated neck portion 40 which engages the inside surface of barrel 10 as illustrated in FIG. 3 to prevent blow-by. Further, insert 30' is provided with shoulder 42 which engages the rearward end of barrel 10 and the forward end of plug 20' as illustrated to aid in preventing blow-by. Insert 30' is also provided with delimination bores $B_1$, $B_2$ and $B_3$ formed therein which communicate with ignition bore $B_4$, in neck portion 40, so that burning gases from the detonated percussion cap on nipple 29 will travel therethrough to ignite the propellant in the breech 14.

Thus, it can be seen that a unique breech plug has been provided which provides a soft metal-to-steel surface between the breech plug and the barrel to prevent blow-by which is not possible when a steel-to-steel contact is provided as in the prior art devices. Similarly, the soft metal-to-steel engagement of the nipple and the rearward end of the insert 30 also ensures that blow-by will be prevented when the powder charge is ignited.

It can also be seen that the fact that the nipple hole IB matches the starting bore of the insert $B_1$ which creates an unrestricted fire path which improves ignition of the powder. It can also be seen that the exploding gases are contained by the breech plug rather than the nipple thereby improving the safety of the firearm.

Thus, it can be seen that the invention accomplishes at least all of its stated objectives.

I claim:

1. A muzzle-loading firearm, comprising, a receiver means having rearward and forward ends, a barrel extending forwardly from said forward end of said receiver means, said barrel having a breech portion at its rearward end, said receiver means including a threaded opening adjacent its forward end for threadably receiving a breech plug therein, a breech plug threadably mounted in said threaded opening of said receiver means, said breech plug having rearward and forward ends and an elongated bore means extending therebetween, said breech plug having an externally threaded portion at its forward end which is threadably received by the threaded opening of said receiver means, said breech plug having an internally threaded opening at its rearward end which communicates with said elongated bore means, a nipple having rearward and forward ends, said nipple having an externally threaded portion at its forward end which is adapted to be threadably received in said internally threaded opening in said breech plug, said nipple having an ignition bore formed therein extending between its rearward and forward ends, the rearward end of said nipple adapted to have a precussion cap mounted thereon so that the percussion cap may ignite a main charge in the breech, said breech plug being comprised of a steel material, said breech plug having an insert mounted in said elongated bore means which protrudes beyond the forward end of said breech plug for sealing engagement with an interior surface of said breech, said insert having rearward and forward ends, said insert being comprised of a material having a hardness less than steel so that a seal will be created between said insert and said breech to prevent blow-by when the firearm is fired, the forward end of said nipple sealably engaging the rearward end of said insert, said insert having a bore means formed therein which extends between the rearward and forward ends thereof.

2. The firearm of claim 1 wherein said insert also provides for a soft metal-to-steel seal between the forward end of said nipple and said breech plug.

3. The muzzle-loading firearm of claim 1 wherein said insert includes a neck portion at its forward end which is sealably received by the rearward end of said barrel.

4. The muzzle-loading firearm of claim 3 wherein said insert also includes a shoulder portion which sealably embraces the rearward end of said barrel.

5. The muzzle-loading firearm of claim 1 wherein the rearward end of said insert is threadably secured to said breech plug.

6. The muzzle-loading firearm of claim 1 wherein said nipple has a bore extending therethrough which has a diameter which matches the rearward end of said bore means in said insert.

7. The muzzle loading firearm of claim 1 wherein said insert is comprised of brass.

8. The muzzle loading firearm of claim 1 wherein said insert is comprised of aluminum.

9. The muzzle loading firearm of claim 1 wherein said insert is comprised of zinc.

10. The muzzle loading firearm of claim 1 wherein said insert is comprised of copper.

* * * * *